US005133836A

United States Patent [19]

Allen

[11] Patent Number: 5,133,836

[45] Date of Patent: Jul. 28, 1992

[54] PAPERMAKING HEADBOX HAVING EXTENDED DIVIDER SHEET

[75] Inventor: Peter J. Allen, Birmingham, Ala.

[73] Assignee: Kimberly-Clark Corporation, Neenah, Wis.

[21] Appl. No.: 762,974

[22] Filed: Sep. 20, 1991

[51] Int. Cl.[5] ..... D21F 1/02

[52] U.S. Cl. ..... 162/343; 162/336; 162/344

[58] Field of Search ..... 162/336, 343, 344, 347, 162/123

[56] References Cited

U.S. PATENT DOCUMENTS

| | | | |
|---|---|---|---|
| 4,125,429 | 11/1978 | Hergert et al. | 162/123 |
| 4,128,455 | 12/1978 | Justus | 162/216 |
| 4,141,788 | 2/1979 | Justus | 162/125 |
| 4,225,382 | 9/1980 | Kearney et al. | 162/111 |
| 4,345,970 | 8/1982 | Radvan et al. | 162/123 |
| 4,376,012 | 3/1983 | Bergstrom | 162/123 |
| 4,376,014 | 3/1983 | Bergstrom | 162/336 |
| 4,381,219 | 4/1983 | Bubik et al. | 162/299 |
| 4,427,491 | 1/1984 | Radvan et al. | 162/299 |
| 4,436,587 | 3/1984 | Andersson | 162/123 |
| 4,445,974 | 5/1984 | Stenberg | 162/300 |
| 4,543,162 | 9/1985 | Hildebrand | 162/343 |
| 4,563,244 | 1/1986 | Syed et al. | 162/344 |
| 4,565,603 | 1/1986 | Reiner et al. | 162/123 |
| 4,617,091 | 10/1986 | Rodal et al. | 162/343 |

*Primary Examiner*—Karen M. Hastings
*Attorney, Agent, or Firm*—Gregory E. Croft

[57] ABSTRACT

The formation of paper webs produced by papermaking headboxes having damaged or imperfectly-formed headbox lips can be improved by providing the headbox with an extended flexible divider sheet which extends beyond the slice opening and is positioned adjacent the defective headbox lip. The extended divider sheet so positioned substantially eliminates the adverse effects of the defective lip on the stock jet characteristics.

5 Claims, 3 Drawing Sheets

PAPERMAKING HEADBOX HAVING EXTENDED DIVIDER SHEET

BACKGROUND OF THE INVENTION

In the manufacture of paper sheets, including creped tissue paper, a headbox is used to deposit the papermaking stock onto a forming wire, where the stock is partially dewatered to form the paper web. Oftentimes the formation of the paper web is flawed due to the presence of minor damage or imperfections in the headbox apron lip, which create jet disturbances as the stock flow leaves the headbox. Correction of these problems usually requires repair or replacement of the headbox apron lip which can be a difficult and inexact task. Therefore, there is a need for a better means for improving web formation defects caused by imperfections in the headbox lip.

SUMMARY OF THE INVENTION

It has now been discovered that web formation affected by imperfections in the apron lip of the headbox can be improved by providing an extended divider at the divider sheet position closest to the damaged or otherwise imperfect apron lip. As is well known in the papermaking industry, headboxes can be provided with a multiplicity of internal divider sheets which create microturbulence in the stock flow to improve mixing and therefore formation of the resulting web as it is deposited onto the forming wire. The number of internal divider sheets is usually about four or more and varies with the headbox design. It is also known to provide extended dividers to produce a layered web, but the extended dividers are symmetrically positioned within the headbox from top to bottom and the internal divider closest to the headbox lip is not one of the extended dividers. The reason is that such extended dividers heretofore used are positioned for separating stock flow and maintaining layer purity in the resulting web. The ability of an extended divider to overcome formation defects, when the extended divider is positioned close to the headbox lip, has not been heretofore appreciated.

Hence in one aspect, the invention resides in an improved papermaking headbox comprising a top wall which ends at a slice lip, a bottom wall which ends at an apron lip, and a plurality of internal divider sheets, wherein the slice lip and the apron lip define a slice opening therebetween, the improvement comprising a flexible extended divider sheet which extends beyond the slice opening and which is positioned adjacent to the top or bottom wall of the headbox. In the case of a layered headbox which has extended layering dividers to form a layered web, the phrase "positioned adjacent to the top or bottom wall of the headbox" means that the extended divider sheet of this invention is positioned between the layering divider and the closest (top or bottom) headbox wall. Hence this invention is applicable to layered or unlayered headboxes. In all cases, it is preferred that the divider sheet which is extended in accordance with this invention is the divider sheet which is the closest to the headbox wall. Depending on the style of headbox, the extended divider sheet of this invention can be next to the apron lip (bottom of the headbox) or the slice lip (top of the slice lip), or there can be two extended divider sheets of this invention wherein one is next to the slice lip and the other is next to the apron lip. A single extended divider sheet next to the apron lip is preferred. The terms "top" and "bottom" of the headbox are used as a matter of convenience to identify the two headbox sidewalls which are approximately parallel to the plane of the internal divider sheets and are intended to also apply to those headboxes which, in operation, are positioned vertically.

DETAILED DESCRIPTION OF THE INVENTION

Figure 1:
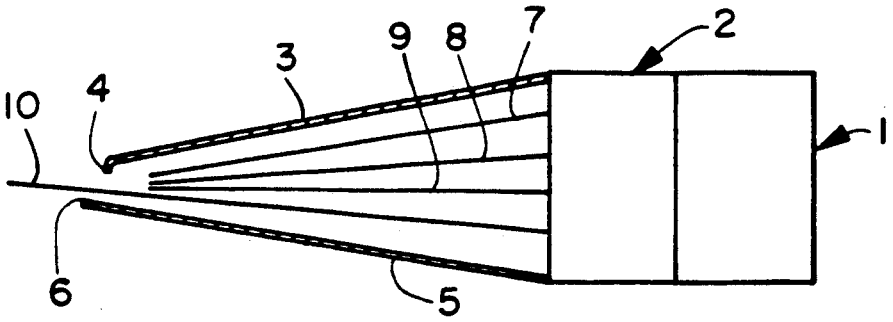
FIG. 1 is a schematic cross-sectional view of a preferred headbox in accordance with this invention, illustrating an extended divider sheet positioned adjacent to the apron lip.

Referring to the drawing, the invention will be described in greater detail. For all of the Figures, like reference numerals represent like features. FIG. 1 is a schematic cross-sectional view of a headbox (Converflow Concept III, Beloit Corporation, Beloit, Wis.) which has been modified by providing an extended divider sheet in accordance with this invention. Shown is the inlet manifold 1, the step-diffuser tube bank 2, the top wall 3, the slice lip 4, the bottom wall 5, the damaged apron lip 6, internal divider sheets 7, 8, and 9, and flexible extended divider sheet 10. The flexible extended divider sheet is made of any material which can withstand the headbox operating conditions and which can flex in response to fluid pressure. An example of a suitable material for extended divider sheets for this particular headbox is Lexan (Polycarbonate, General Electric, Pittsfield, Massa.). The thickness of the extended divider sheets can be, for example, about 0.40 inch and is preferably tapered toward the tip. The flexible extended divider sheet preferably extends beyond the slice opening a distance of about fifteen times the height of the slice opening. However, lesser degrees of extension can still provide improvements in the formation and are within the scope of this invention. For example, for the headbox used to provide the photographs of FIGS. 6 and 7, the single extended divider sheet extended 1.0 and 3.75 inches, respectively, beyond the apron lip. The height of the slice opening for that headbox was 0.50 inch. For most tissue making headboxes, however, extensions of about 2 inches or more, and preferably about 6 inches or more, beyond the slice opening are preferred.

Figure 2:
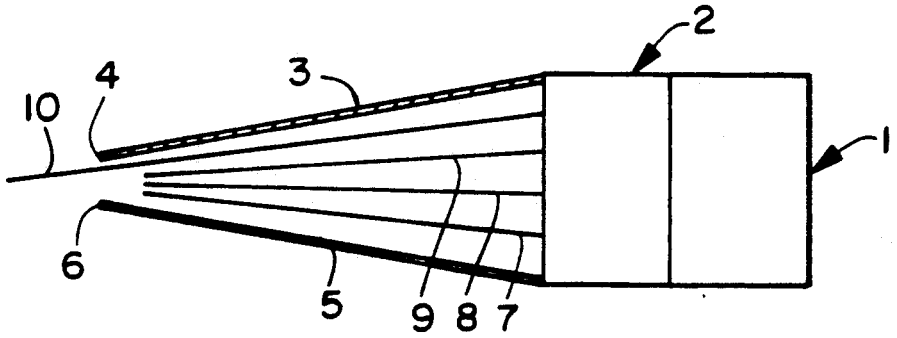
FIG. 2 is a schematic cross-sectional view of an alternative headbox of this invention illustrating an extended divider sheet positioned adjacent to the slice lip.

FIG. 2 is a view similar to that of FIG. 1, illustrating an alternative embodiment of this invention wherein the extended divider sheet is adjacent to the top wall rather than the bottom wall of the headbox.

Figure 3:
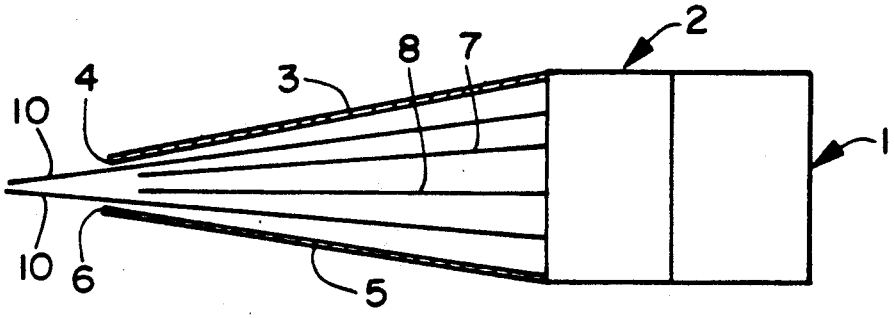
FIG. 3 is a schematic cross-sectional view of an alternative headbox of this invention having an extended divider sheet positioned adjacent to both headbox lips.

FIG. 3 is also similar to that of FIGS. 1 and 2, illustrating a further embodiment of this invention in which two extended divider sheets 10 are provided, one being adjacent to the top wall and the other being adjacent to the bottom wall of the headbox. In this embodiment, only two internal divider sheets are shown although, as with all of the other embodiments, there can be more internal divider sheets depending on the design and size of the headbox.

Figure 4:
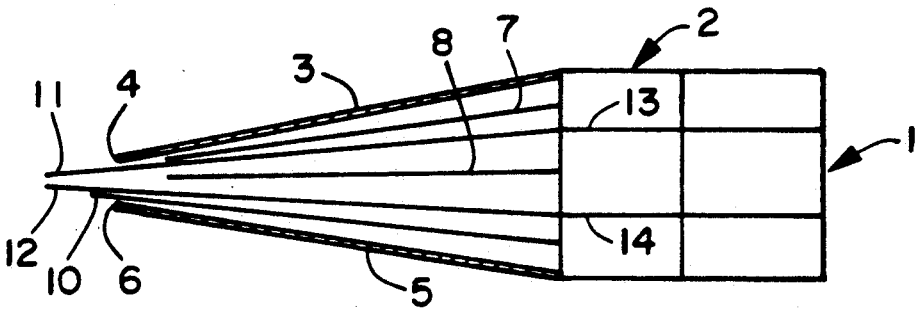
FIG. 4 is a schematic cross-sectional view of an alternative headbox of this invention in which the headbox is a three-layered headbox having two extended layering dividers in addition to the extended divider sheet of this invention.

FIG. 4 is a view similar to FIG. 3, illustrating an embodiment of this invention in which a three-layered headbox, having two extended layering dividers 11 and 12, has one extended divider sheet 10 adjacent to the apron lip. Also indicated are partitions 13 and 14 which separate the different stocks for the three layers. Note that as is typical for layered headboxes, an internal divider sheet (7, 8, and 10) is present within each layer and hence neither extended layering divider 11 or 12 is positioned adjacent to the top or bottom wall of the headbox. This is one distinguishing characteristic between conventional extended layering dividers and the extended divider sheets of this invention. In operation, another distinguishing feature is the fact that the papermaking stock flowing on both sides of the extended divider sheets of this invention is the same, whereas for extended layering dividers the stocks on either side of the layering dividers are different. An alternative embodiment of this invention includes two extended divider sheets in conjunction with a layered headbox. This can be achieved by extending divider sheet 7 of FIG. 4. Note that in all cases where two extended divider sheets are utilized, the degree to which each extends beyond the slice opening can be the same or different, depending on design requirements.

Figure 5:
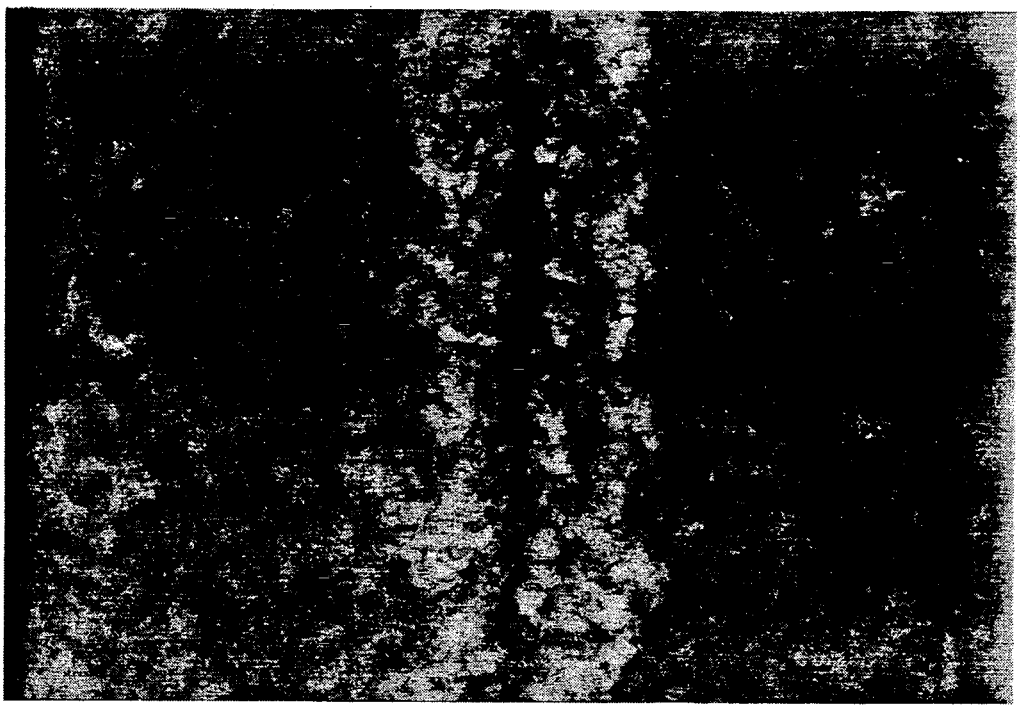
FIG. 5 is an actual size photograph of a paper sheet made with a headbox as illustrated in FIG. 1 having a damaged apron lip, illustrating the streaking caused by poor formation resulting from the damaged apron lip.
Figure 6:
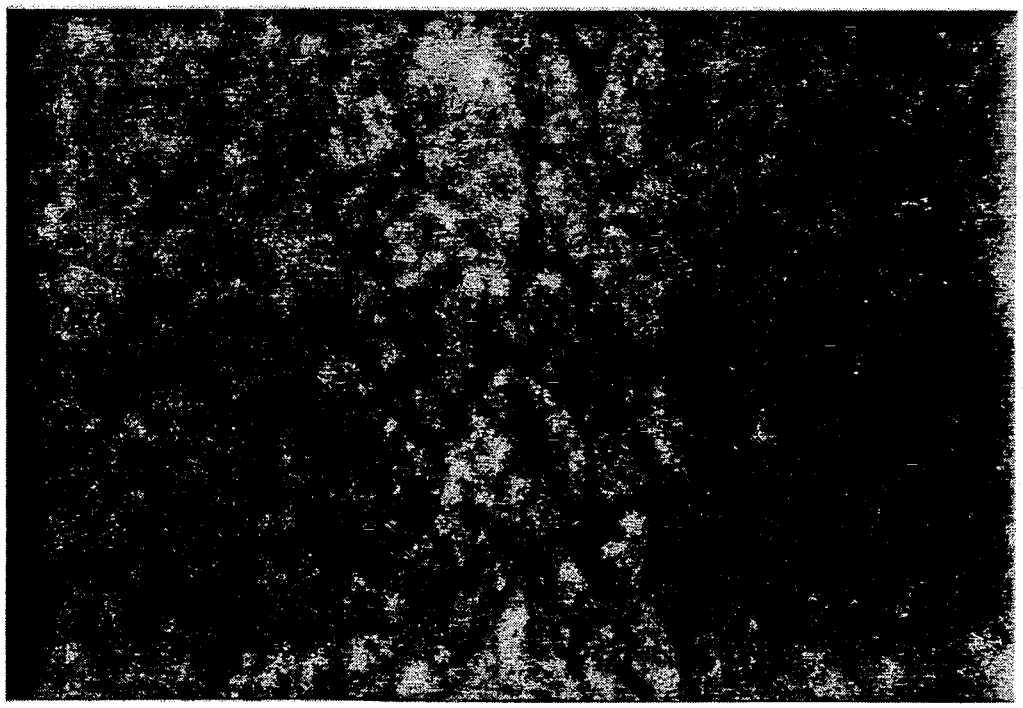
FIG. 6 is an actual size photograph of a paper sheet made with the same headbox as was used to make the paper sheet shown in FIG. 5, but having an extended divider sheet positioned adjacent to the damaged apron lip in accordance with this invention (extending 1.0 inch beyond the slice opening), illustrating the resulting improved sheet formation.
Figure 7:
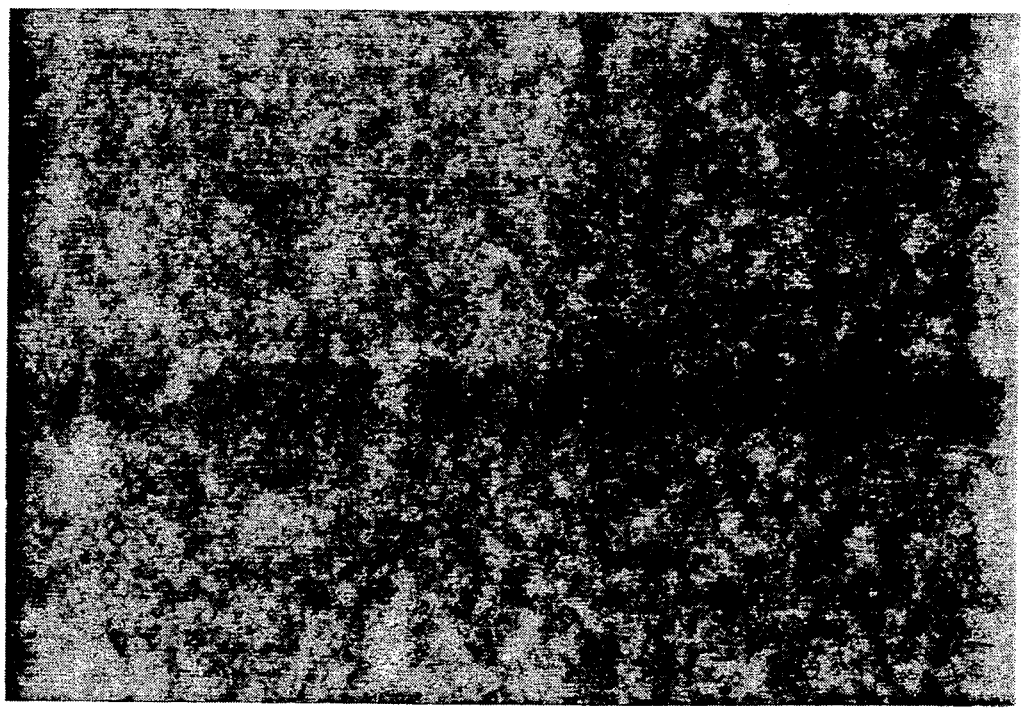
FIG. 7 is an actual size photograph of a paper sheet made with the same headbox as was used to make the paper sheet shown in FIGS. 5 and 6, but having the extended divider sheet positioned adjacent to the damaged apron lip in accordance with this invention and extending 3.75 inches beyond the slice opening.

FIG. 5 is a photograph of an uncreped paper sheet made on a conventional headbox (Beloit Converflow, Concept III) having a damaged apron lip. The photograph was taken by passing light up through the sheet such that the light areas of the photograph indicate holes or thinner areas of the sheet. Note the two large light streaks indicating poor formation uniformity. In contrast, FIGS. 6 and 7 are photographs of the uncreped paper sheet made on the same headbox, but provided with a flexible extended divider sheet (Lexan) as illustrated in FIG. 1 and previously described. The extended divider sheet used for making the paper sheet of FIG. 6 extended beyond the slice opening 1.0 inch. The extended divider sheet used for making the sheet of FIG. 7 extended beyond the slice opening 3.75 inches. Note the improved uniformity and substantial reduction of the effects of the apron lip damage as the amount of the extension beyond the slice opening increases. It is believed that further extensions would further improve the formation of the sheet as well as the ability to mask the disturbances caused by any other headbox lip imperfections.

It will be appreciated that the foregoing specific embodiments, given for purposes of illustration, are not to be construed as limiting the scope of the invention, which is defined by the following claims and includes all equivalents thereto.

I claim:

1. In a papermaking headbox comprising a top wall which ends at a slice lip, a bottom wall which ends at an apron lip, the slice lip and the apron lip defining a slice opening therebetween, and a plurality of internal divider sheets that do not extend beyond the slice opening, the improvement comprising a first flexible extended divider sheet which extends through and beyond the slice opening and which is positioned directly adjacent to the top wall, a second flexible extended divider sheet which extends through and beyond the slice opening and which is positioned directly adjacent to the bottom wall, and said plurality of internal divider sheets positioned between the first and second flexible extended divider sheets.

2. In a papermaking headbox comprising a top wall which ends at a slice lip, a bottom wall which ends at an apron lip, the slice lip and the apron lip defining a slice opening therebetween, a plurality of internal dividers that do not extend beyond the slice opening, and having a divided inlet for receiving different stocks and extended layering dividers which maintain separation of the stock until after the different stocks leave the slice opening, the improvement comprising at least one flexible extended divider sheet which extends through and beyond the slice opening and which is positioned directly adjacent to the top or bottom wall of the headbox, and wherein none of the extended layering dividers are directly adjacent to the top or bottom headbox walls.

3. The headbox of claim 1 or 2 wherein the flexible extended divider sheet(s) extend(s) beyond the slice opening at least about 2 inches.

4. The headbox of claim 1 or 2 wherein the flexible headbox divider sheet(s) extend(s) beyond the slice opening at least about 6 inches.

5. The headbox of claim 1 or 2 wherein said plurality of internal dividers comprise four or more internal divider sheets.

* * * * *